United States Patent [19]

Hartmann

[11] Patent Number: 4,683,010

[45] Date of Patent: Jul. 28, 1987

[54] COMPACTED WIRE SEAL AND METHOD OF FORMING SAME

[75] Inventor: Hans J. Hartmann, Woonsocket, R.I.

[73] Assignee: ACS Industries, Inc., Woonsocket, R.I.

[21] Appl. No.: 782,499

[22] Filed: Oct. 1, 1985

[51] Int. Cl.[4] ..... C23C 8/14

[52] U.S. Cl. ..... 148/6.35; 277/230; 277/235 R; 277/DIG. 6; 277/236

[58] Field of Search ..... 148/6.35; 277/230, 235 R, 277/236, DIG. 6

[56] References Cited

U.S. PATENT DOCUMENTS

| | | | |
|---|---|---|---|
| 2,924,471 | 2/1960 | Poltonak | 277/230 |
| 3,033,722 | 5/1962 | Gooloe | 277/230 |
| 3,343,362 | 9/1967 | Lunsford | 148/6.35 |
| 3,637,223 | 1/1972 | Weber | 277/236 |
| 4,601,476 | 7/1986 | Usher | 277/235 R |

*Primary Examiner*—Sam Silverberg
*Attorney, Agent, or Firm*—Salter & Michaelson

[57] ABSTRACT

A compacted knitted wire seal and a method of forming the seal. The method comprises the steps of knitting a flattened wire to form a tubular sock, rolling the sock on itself, heating the rolled sock in an atmosphere containing oxygen to anneal the wire in the sock and to form oxides on the surfaces of the wire, and compressing the annealed and oxidized ring to form a compacted wire ring seal of preferably V-shaped cross section. The seal made by the method has sufficient flexibility to permit it to compensate for minor irregularities in the configurations of elements with which it is positioned in engagement, and the oxides on the surfaces of the wire in the seal improve the leak-rate qualities of the seal. The seal is particularly effective for use in automotive catalytic converters, wherein it is utilized for sealing between monolith and housing portions of converters.

8 Claims, 11 Drawing Figures

COMPACTED WIRE SEAL AND METHOD OF FORMING SAME

BACKGROUND AND SUMMARY OF THE INVENTION

The instant invention relates to seals and more particularly to a seal made from compacted wire which is particularly effective for use in high-temperature applications.

For many years, seals and gaskets containing asbestos were utilized for most high-temperature applications. However, with the discovery that asbestos has carcinogenic properties, the use of seals containing asbestos has been severely restricted, and therefore a need has developed for an effective high-temperature seal which does not contain asbestos. In this connection, although a number of materials other than asbestos have been heretofore available which can withstand prolonged exposure to high temperatures, they have generally not had sufficient resiliency and flexibility to make them effective for use in many types of gaskets. Hence, there has remained a substantial need for an effective asbestos-free gasket and/or seal construction which can be utilized in high-temperature applications and which has a certain degree of resiliency and flexibility.

Heretofore it has generally been known that seals and/or gaskets which are suitable for some applications can be made from compacted knitted-wire elements. More specifically, it has been known to form seals and/or gaskets comprising elements which are made by knitting wire to form sheets or tubular socks, rolling the sheets or socks to form rolls or rings of knitted wire and then compressing the rolls or rings to form compacted knitted-wire elements. Knitted-wire elements of this type have been utilized as the core elements for seals, wherein they are covered with fiberglass fabrics for providing reduced leakage rates. Further, it has also been known to impregnate knitted-wire elements of the above type with various types of filler materials to provide the necessary reduced leakage rates so that they can be utilized for seals and/or gaskets. However, the use of compacted knitted-wire elements for seals and/or gaskets without utilizing them in combination with filler and/or covering materials has not been feasible, since gaskets made from knitted-wire elements which have not included outer casings or filler materials have generally had excessively-high leak rates.

The instant invention relates to a seal construction comprising a compacted knitted-wire element which does not require the use of outer casings or extraneous filler materials. More specifically, the instant invention relates to an effective method of forming a compacted wire seal which is operative with reduced leak rates and to the seal itself. The method of forming a compacted wire seal in accordance with the instant invention comprises the steps of knitting an elongated wire to form a sheet of knitted wire which may be either flat or of tubular configuration and rolling the sheet to form a roll or ring of knitted wire. The method further comprises the steps of heating the roll or ring of knitted wire in an atmosphere containing oxygen to form oxides on the surfaces of the wire and to anneal the wire, and then compressing the wire in a die cavity to form a compacted wire seal. In the preferred form of the method, the wire comprises stainless-steel wire, and it is flattened before it is knitted in the knitting step. Further, in the preferred form of the method, the wire is formed into a tubular sock, and the sock is rolled on itself from both ends thereof to form two adjacent rolls. Still further, in the preferred form of the method, the heating step is carried out so that oxides are formed on the surfaces of the wire in an amount comprising at least approximately 0.025 $mm^3$ of oxide per $cm^2$ of wire surface; and in the compressing step the rolled wire is compressed to a density wherein it comprises at least approximately 45% by volume of wire and oxide. Still further, in the preferred form of the method, after the wire has been knitted to form a tubular sock, rolled on itself to form a knitted-wire ring, and heated to form the oxides on the wire and to anneal the wire, the ring is compressed in a die cavity to form a compacted wire-ring seal having a V-shaped cross-sectional configuration. Specifically, the seal is preferably formed so that it has a V-shaped configuration wherein the apex of the V-shape thereof is disposed on one side of the seal and the legs of the V-shape diverge from the apex to define the inner and outer extremities of the seal.

It has been found that the compacted wire seal of the instant invention which is made in accordance with the hereinabove-described method can be effectively utilized in applications wherein slow gas-leakage rates can be tolerated. In this connection, however, it has been found that because of the method by which the seal of the instant invention is made, it has substantially reduced leakage rates in comparison to gaskets made from other types of compacted knitted-wire elements. Specifically, by heating the knitted wire in an atmosphere containing oxygen after the wire has been formed into a roll or a ring, oxides are produced on the surfaces of the wire; and when the roll or ring of knitted wire is thereafter compressed, these oxides fill in some of the void areas in the compacted wire seal to reduce the leakage rates which are obtained with the seal. Further, when the knitted wire seal is formed in a V-shaped configuration, it has sufficient resiliency in the legs of the V-shape thereof to compensate for minor irregularities in the surfaces of elements with which it is positioned in engagement. In particular, when the seal is mounted so that a first element is received in engagement with the inner periphery of the seal and a second element is received in engagement with the outer periphery thereof, the V-shape of the seal and the resiliency and flexibility of the compacted wire construction thereof allow it to be maintained in sealing engagement with the first and second elements regardless of irregularities in the surface configurations thereof. In this connection, while V-shaped configurations are generally known for various types of seals, heretofore they have only been applied to positive seals having solid constructions, and they have not been applied to seals made of compacted knitted wire. Hence, the heretofore-available compacted knitted-wire seals have not been effectively able to cushion elements in the manner of the seal of the instant invention, and they have not been compressible in the manner of the seal of the instant invention.

One particular application for high-temperature seals is in catalytic converters of the type used for treating exhaust gases on automobiles, trucks, and the like. In this connection, most catalytic converters of this type comprise a ceramic monolith through which exhaust gases can pass, a platinum catalyst which is deposited on the monolith, a refractory or wire-mesh blanket which is received around the ceramic monolith, a metallic housing in which the monolith and the refractory or wire-mesh blanket are mounted, and a seal between the monolith and the housing. Further, in this connection, the housing of a catalytic converter of this type is constructed for receiving exhaust gases and for directing them so that they pass through the monolith. The refractory or wire-mesh blanket is provided for protecting and cushioning the monolith so that it does not contact the housing and fracture, and the seal of a catalytic converter of this type is provided for sealing between the monolith and the housing so that substantial quantities of exhaust gases do not bypass the monolith, although relatively low leak rates can generally be tolerated. Heretofore seals of the type comprising a compacted wire element with a fiberglass cloth sleeve thereon have been utilized for applications of this type. However, these seals have been made from elongated compacted wire elements rather than from compacted wire rings, and hence they have had seams where they have been formed into rings. These seams have been known to cause breakage in monolith elements. Further, seals of this type have not been able to effectively conform to housings in which they have been mounted, and they have also been relatively expensive.

It has been found that the seal of the instant invention can be economically made and that it is particularly effective for use in catalytic converters of the above-described type. Specifically, the seal of the instant invention, which is preferably made in a V-shaped configuration, can effectively seal between the monolith and the housing of a catalytic converter, since it can compensate for minor irregularities in the configurations of the housing and/or the monolith. Further, when the seal is constructed from stainless-steel wire, it can withstand very high temperatures which are often experienced in catalytic converters; and since the seal is formed as an endless ring without seams, it is less likely to damage a monolith element of a catalytic converter. Still further, because oxides are formed on the surfaces of the wire in the seal of the instant invention before the seal is formed into a V-shaped configuration, the seal can effectively meet the leak-rate standards for catalytic converters. Even further, since the oxides on the wire of the seal of the instant invention are actually formed on the surfaces of the wire rather than being filler materials which are added to the seal, the risk that particulate matter will escape from the seal and contaminate or clog downstream components, such as additional catalytic converter elements or monoliths, is substantially reduced.

Accordingly, it is a primary object of the instant invention to provide a method of manufacturing an effective compacted wire seal.

Another object of the instant invention is to provide an effective compacted-wire seal.

A still further object of the instant invention is to provide a method of making an effective high-temperature seal for the monolith of a catalytic converter.

An even still further object of the instant invention is to provide an effective high-temperature seal for a monolith of a catalytic converter.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 5:
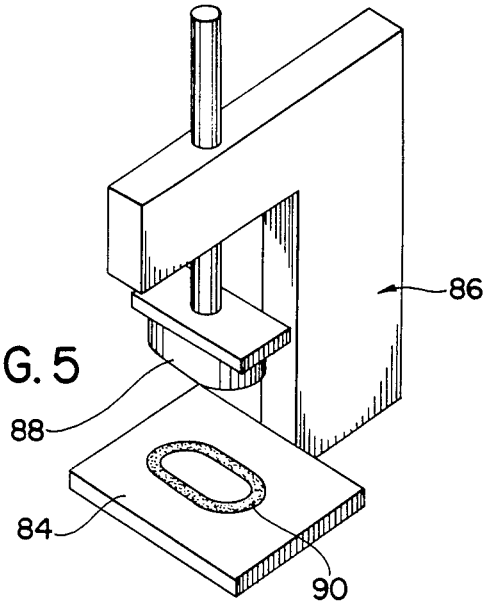
Figure 6:
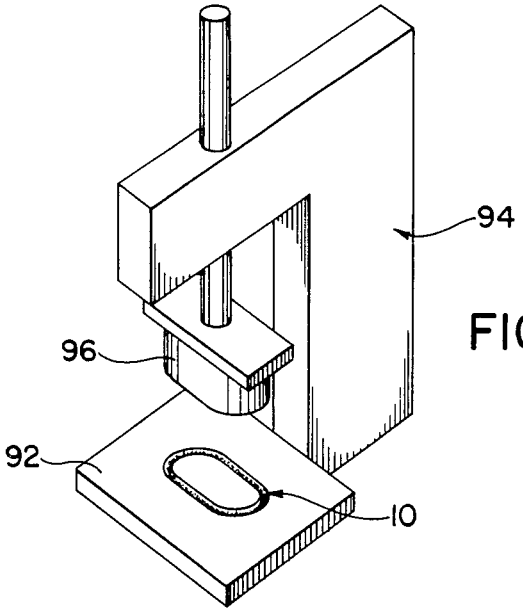
Figure 7:
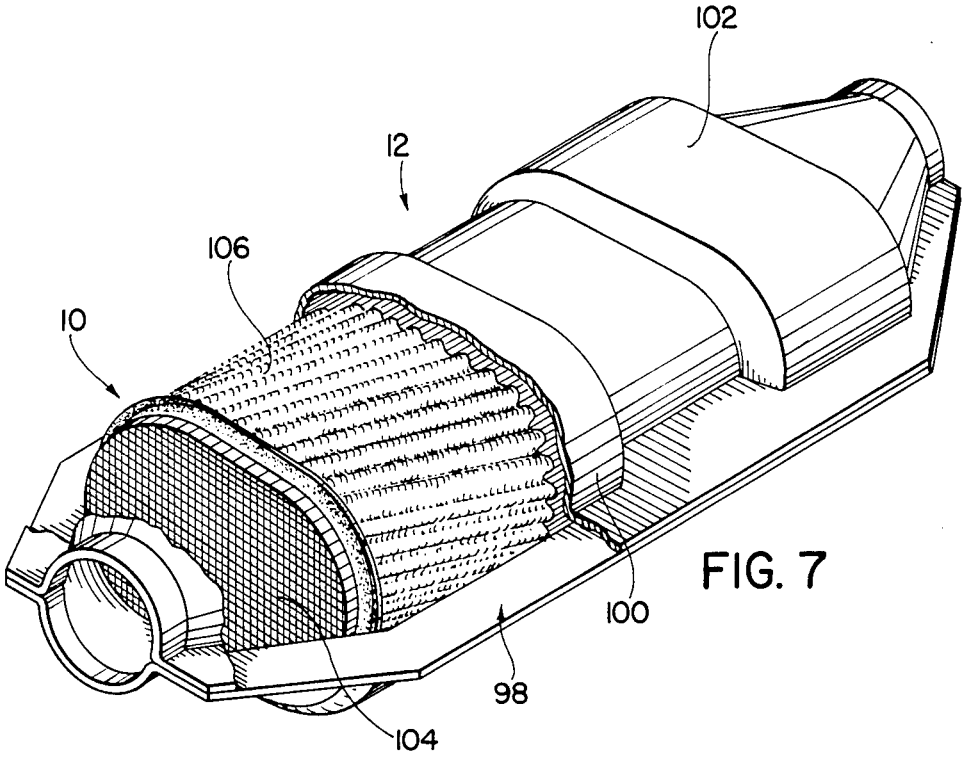
FIG. 7 is a fragmentary perspective view of a catalytic converter comprising the seal of the instant invention.
Figure 8:
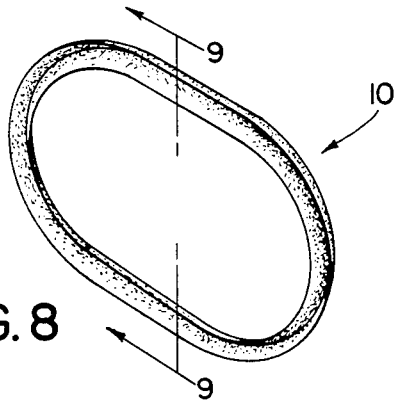
FIG. 8 is a perspective view of the seal per se.
Figure 9:
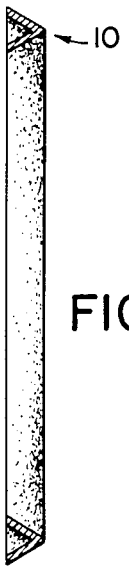
FIG. 9 is a sectional view taken along line 9—9 in FIG. 8.

Referring now to the drawings, the method of the instant invention is illustrated in FIGS. 1 through 6, and the seal of the instant invention which is made by the method is illustrated in FIGS. 7 through 9 and generally indicated at 10. The seal 10 as herein embodied is formed as a continuous ring having a V-shaped cross-sectional configuration as illustrated most clearly in FIG. 9, and it is particularly adapted for use in a catalytic converter of the type illustrated in FIG. 7 and generally indicated at 12 as will hereinafter be more fully set forth. It will be understood, however, that a variety of other uses for the seal of the instant invention in both high-temperature and low-temperature applications are contemplated.

Figure 1:
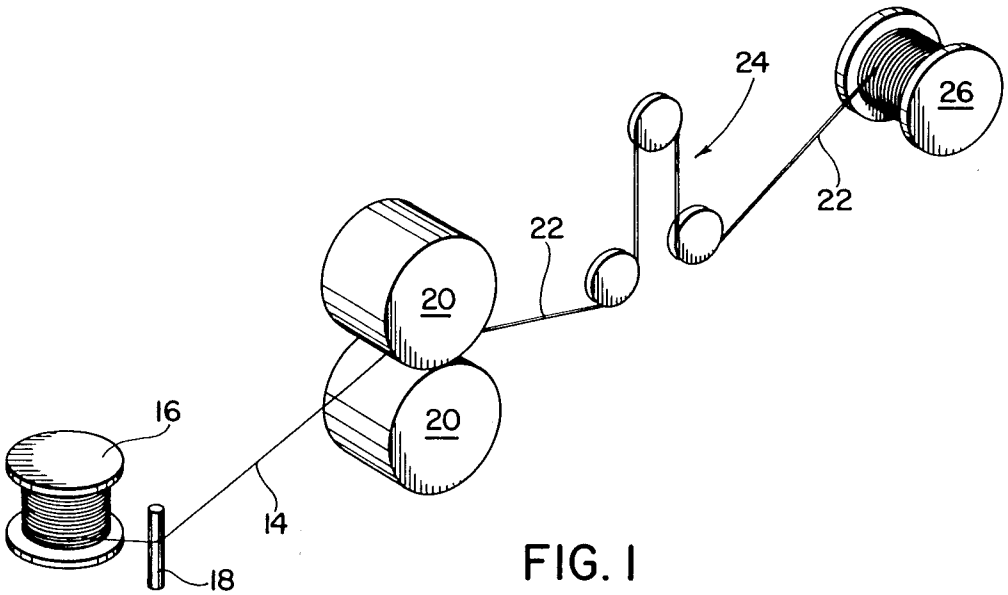
FIG. 1 is a perspective view of the flattening step of the method of the instant invention.

Referring first to FIG. 1, the first step of the method of forming the seal of the instant invention is illustrated. As will be seen, in the first step of the method, a wire 14 is unwound from a spool 16 so that it passes around an alignment pin 18 and between a pair of hardened flattening rollers 20 to produce a flattened wire 22. The wire 14 preferably comprises a stainless-steel wire having a diameter which is preferably less than approximately 0.020 inch, and the flattened wire 22 is preferably flattened to a thickness of approximately 0.001 inch as it is passed between the flattening rollers 20. After the wire 14 has been passed between the flattening rollers 20, the flattened wire 22 thereby formed is passed over a dancer-roller assembly 24 to maintain adequate tension in the wire 22, and then the flattened wire 22 is wound on a take-up spool 26.

Figure 2:
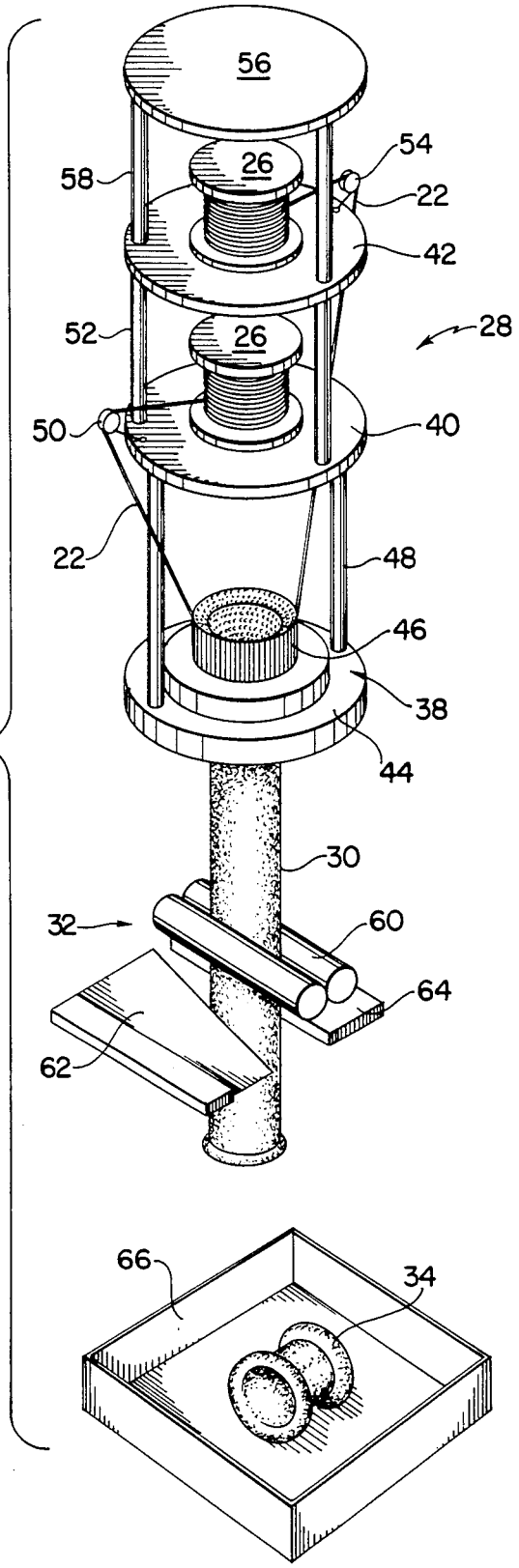
FIG. 2 is a perspective view illustrating the knitting step of the method.

In the second step of the method which is illustrated in FIG. 2, the flattened wire 22 is knitted in a knitting assembly generally indicated at 28 to form a continuous tubular knitted sock 30, and the sock 30 is cut by means of a cutting assembly 32 to form tubular sock sections 34 of a predetermined length. As will be seen, the tubular sock sections 34 are partially rolled upon themselves from the opposite ends thereof as a result of the natural characteristics of the knitted sock 30. However, in accordance with the preferred form of the method, they are further rolled upon themselves in a subsequent step to form rolled rings 36 as will hereinafter be more fully set forth. It will also be understood that other forms of the method wherein the wire 22 is knitted into sheets of nontubular configuration to make seals of non-ring-like configurations, such as elongated seal strips, are contemplated.

The knitting assembly 28 comprises a knitting head 38, a first spool-support frame 40 and a second spool-support frame 42. The knitting head 38 comprises a base 44 and a knitting needle assembly 46 on the base 44, and it is operative in a conventional manner for producing tubular knitted-wire socks. More specifically, it is operative in a manner similar to the apparatus disclosed in the U.S. Pat. Nos. 2,445,231 and 2,425,293 to McDermott for producing the tubular knitted-wire sock 30. The first spool-support frame 40 is mounted in spaced relation above the knitting head 38 on columns 48, and a first spool 26 containing flattened wire 22 is rotatably received in the frame 40 so that the wire 22 therefrom passes over a guide roller 50 on the frame 40 and downwardly to the knitting needle assembly 46. Similarly, the second spool-support frame 42 is mounted in spaced relation above the first spool-support frame 40 on columns 52, a second spool 26 of flattened wire 22 is rotatably supported on the second frame 42, and wire 22 from spool 26 on the second frame 42 passes over a guide roller 54 and downwardly to the knitting needle assembly 46. A cover plate 56 is mounted on columns 58 above the support plate 42. The cutting assembly 32 comprises a pair of rollers 60 which draw the sock 30 downwardly from the knitting head 38 as it is formed therein, and a cutting blade 62 which is operative in cooperation with a base plate 64 for cutting the sock 30 to form the sock sections 34 which fall into a container 66 as they are cut.

Figure 2A:
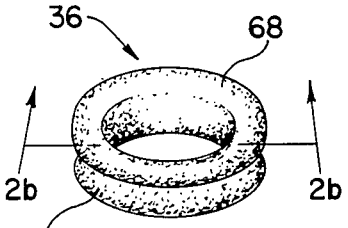
FIG. 2*a* is an elevational view of a knitted sock which has been rolled into a ring.
Figure 2B:
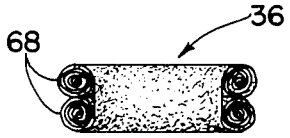
FIG. 2*b* is a sectional view taken along line 2*b*—2*b* in FIG. 2*a;*

In the next step of the method, the tubular sock sections 34 are rolled on themselves from their respective opposite ends to form the rings 36 which each comprise a pair of adjacent rolls 68 as illustrated in FIGS. 2*a* and 2*b*. It will be understood that in other forms of the method wherein sheets of knitted wire are formed in nontubular configurations, such as flattened sheets, the sheets are rolled in a similar manner in this step of the method. In any event, as illustrated in FIG. 2*b*, because the sock sections 34 are each rolled from both ends thereof to form the rings 36, there is a more even distribution of wire material in the seal 10 which is eventually formed in the remaining steps of the method of the instant invention, and the seal 10 comprises a greater quantity of wire material in the circumferential portions thereof. Specifically, because the ring 36 comprises a pair of rolls 68, the outer circumferential extremities of the seal 10 which is eventually formed includes the outer layers of material from both of the rolls 68 rather than from a single roll 68.

Figure 3:
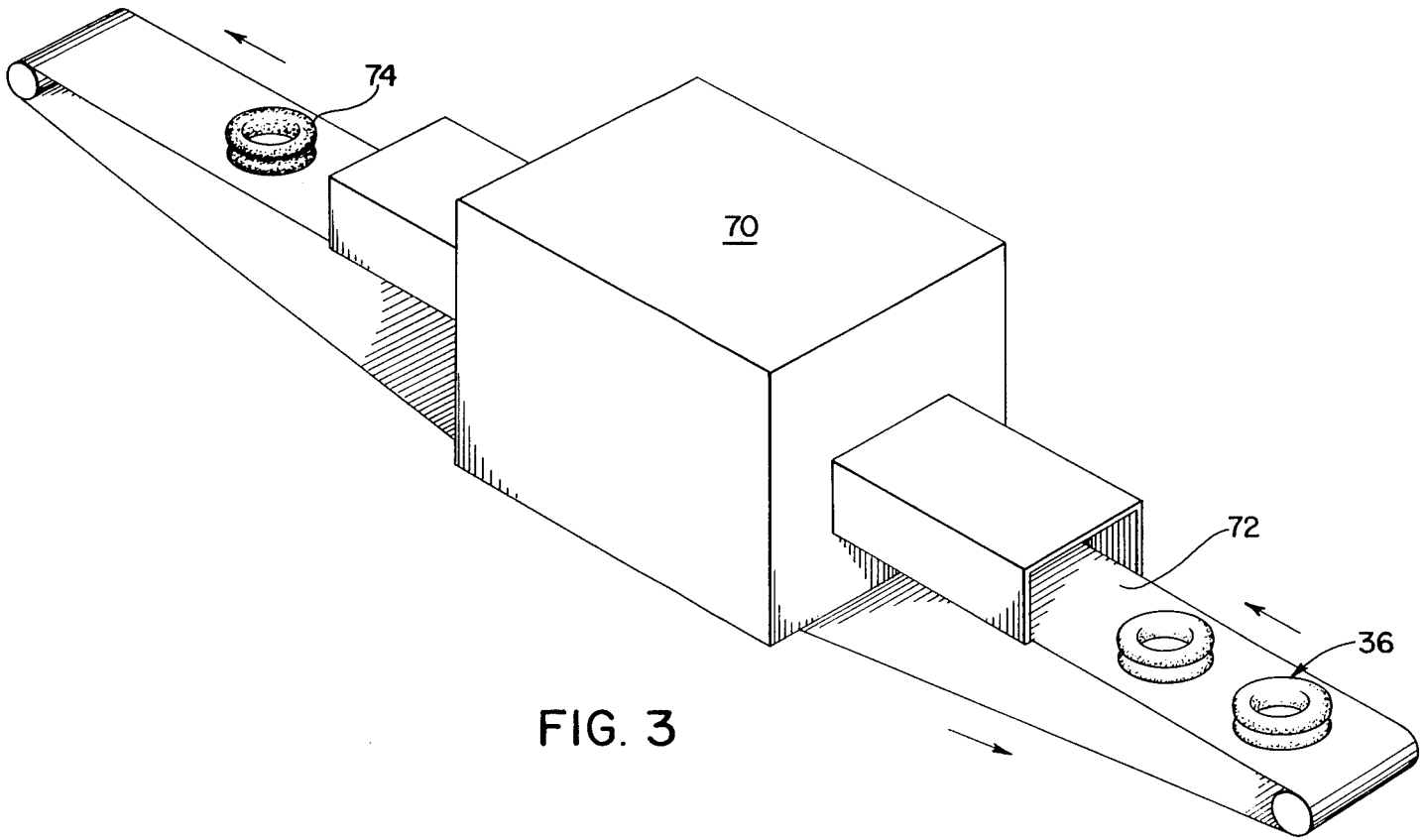
FIG. 3 is a perspective view of the heating step of the method.

In the next step of the method of the instant invention which is illustrated in FIG. 3, the rings 36 or other elements formed in the preceding steps are heated in a furnace 70 to anneal the wire 22 therein and to form oxides on the surfaces of the wire 22. More specifically, the rings 36 are passed through the furnace 70 on a belt 72 in order to form annealed and oxidized rings 74 which are darkened in appearance as a result of the oxides which are formed on the surfaces thereof. In this connection, while most annealing operations of this type are carried out in oxygen-free atmospheres to prevent the formation of oxides, the oven 70 is operated in the presence of air so that oxides are formed on the surfaces of the wire 22 in the rings 36. The oven 70 is preferably operated at a temperature in excess of 1950° F., and it is preferably operated so that the rings 36 which are passed therethrough have residence times in the oven 70 of between two and three minutes, it having been found that these conditions are sufficient to both anneal the wire 22 in the rings 36 and to produce the desired quantities of oxides on the surfaces thereof. In this regard, the annealed and oxidized rings 74 preferably comprise at least approximately 0.025 $mm^3$ of oxide per $cm^2$ of wire surface area and preferably approximately 0.1 $mm^3$ of oxide per $cm^2$ of surface area.

Figure 4:
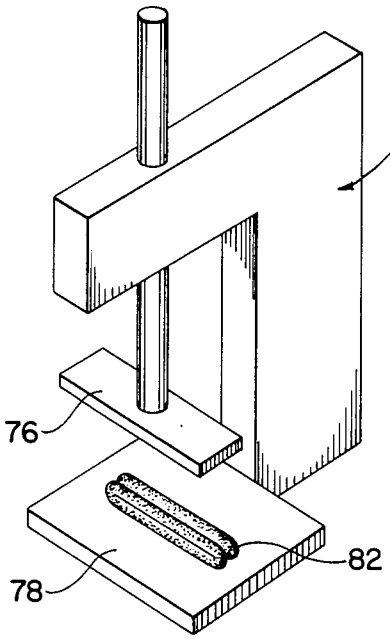
FIGS. 4 through 6 are sequential perspective views illustrating the compressing step.

In the next step of the method of the instant invention, the annealed and oxidized rings 74 are compressed in the manner illustrated in FIGS. 4 through 6 to form the seal 10, it being understood that other elements made by the method of the instant invention in non-ring-like configurations would be compressed in a similar manner. As illustrated in FIG. 4, a ring 74 is first pressed between a pair of substantially flat plates 76 and 78 in a first press 80 to form a flattened ring 82. Thereafter, as illustrated in FIG. 5, the ring 82 is assembled in a die cavity in a die 84 of a second press 86 and compressed in the die cavity of the die 84 with a second die 88 to form a partially-compressed ring 90. Thereafter, as illustrated in FIG. 6, the partially-compressed ring 90 is assembled in a die cavity in a die 92 of a third press 94, and the partially-compressed ring 90 is further compressed with a die 96 of the press 94 to produce a seal 10. In this connection, the dies 84 and 88 and the dies 92 and 96 are configured so that the seal 10 is formed in an oval configuration and so that it has a V-shaped cross-sectional configuration, as illustrated in FIG. 9. In this regard, the dies 84, 88, 92 and 96 are configured so that the apex of the V-shape of the seal 10 is disposed on one side thereof and so that the legs of the V-shape of the seal 10 diverge from the apex to define the inner and outer extremities of the oval configuration thereof. Preferably the seal 10 is compressed in the presses 86 and 94 so that it has a density wherein it comprises at least approximately 45% wire and oxide. Further, the V-shaped configuration of the seal 10 is preferably formed with an angle of approximately 60° between the two legs thereof.

It has been found that the seal 10 which is manufactured in accordance with the hereinabove-described method can be effectively utilized for sealing applications, wherein low gas-leakage rates can be tolerated. In this connection, the oxides which are deposited on the surfaces of the wire 22 in the rings 74 before the rings 74 are compressed tend to fill in the voids which inherently occur between the pieces of wire 22 in the seal 10 so that the oxides substantially reduce the rates at which gases can pass or leak through the seal 10. Further, the V-shaped cross-sectional configuration of the seal 10 makes it sufficiently resiliently flexible to compensate for minor irregularities in the configurations of elements with which it is positioned in engagement. More specifically, the legs of the V-shaped cross-sectional configuration of the seal 10 can be resiliently compressed together to compensate for irregularities in the configurations of elements with which the seal 10 is positioned in engagement.

The use of the seal 10 in a catalytic converter 12 is illustrated in FIG. 7. As will be seen, the catalytic converter 12 comprises a split housing generally indicated at 98 which comprises primary and secondary housing sections 100 and 102. Contained within each of the housing sections 100 and 102 is a monolith 104 having platinum deposited on the surfaces thereof, a wire-mesh blanket 106 which is wrapped around the monolith 104, and a seal 10 which is received on monolith 104 adjacent the upstream end thereof and adjacent the blanket 106 thereon. When the seal 10 is assembled in the converter 12 in this manner, it snugly engages both the monolith 104 and the housing 98, and it provides an effective seal between the housing 98 and the monolith 104 which substantially restricts the amount of gases which can pass through the housing 98 without passing through the adjacent monolith 104. Since the seal 10 is preferably made from stainless-steel wire, it can withstand extremely high temperatures to which it is likely to be exposed in the catalytic converter 12; and since the seal 10 is made without the addition of filler materials, it can be economically manufactured, and it is not likely to emit particulate matter which will contaminate the monolith 104 in the secondary housing section 102.

EXAMPLE

In a specific test application of the method of the instant invention to form a seal for a catalytic converter, T-309 stainless-steel wire having a diameter of approximately 0.0045 inch was flattened to produce a ribbon or flattened wire having a width of approximately 0.016 inch and a thickness of approximately 0.001 inch. The ribbon was then knitted to form a series of tubular socks having diameters of approximately 3 inches and lengths of approximately 20 inches, and the socks were each rolled on themselves from opposite ends thereof to form rings, each comprising a pair of adjacent rolls. One hundred rings which were made in this manner were weighed and then heated in an air atmosphere at approximately 2050° F. for approximately two to three minutes, and thereafter the rings were cooled and weighed again. It was found that the average weight of the rings had increased from 18.94 grams to 19.03 grams or approximately 0.475% as a result of oxides which were formed on the surfaces of the wire during the heating step. It was also found that a noticeable darkening in the color of the wire in the rings had taken place. It was calculated that the oxides were formed in a quantity of approximately 0.118 $mm^3$ of oxide per $cm^2$ of wire surface area. The oxidized rings were flattened and then pressed in a preliminary oval die cavity having a generally V-shaped cross section and a depth of approximately 1.25 inches. Finally, the rings were pressed in a final die cavity so that they were formed in the general configuration of the ring 10 illustrated in FIGS. 8 and 9. In this connection, the finished rings were pressed so that they had densities wherein they comprised approximately 50% wire and oxides.

In order to test the effectiveness of the seals formed during the test, samples thereof were individually assembled in a structure resembling a catalytic converter having a solid monolith element so that the only leakage through the converter would be through the seals. The weights of the seals tested and the leakage rates which were achieved when air at 2 psi was applied to the simulated catalytic converter are tabulated below.

| Seals with Oxidized Wire | |
|---|---|
| Part Weight (Grams) | Leak Rate (SCFM) |
| 18.5 | 1.80 |
| 18.5 | 1.72 |
| 18.8 | 1.40 |
| 19.1 | 1.90 |
| 19.1 | 1.65 |

-continued

| Seals with Oxidized Wire | |
|---|---|
| Part Weight (Grams) | Leak Rate (SCFM) |
| 19.3 | 1.70 |
| 19.4 | 1.87 |
| 19.5 | 1.70 |
| 19.5 | 1.87 |
| Average leak rate | 1.74 SCFM |

In order to determine the effectiveness of the method of the instant invention, and in particular the importance of oxidizing the wire in the seals during the method, a second group of 200 knitted-wire rings was made in the same manner hereinabove described. These rings, however, were heated in an oxygen-free atmosphere so that they were only annealed and not oxidized, and therefore they exhibited no noticeable change in color after the heating step. After the rings had been heated, they were compressed into seals having the same general configuration as the seal 10 illustrated in FIGS. 8 and 9, and they were tested in the simulated test-catalytic converter hereinabove described which comprised a solid monolith element. The weights of the seals and leak rates which were achieved when 2 psi air was applied to the test converter are listed below.

| Seals with Unoxidized Wire | |
|---|---|
| Part Weight (Grams) | Leak Rate (SCFM) |
| 18.1 | 2.08 |
| 18.2 | 2.18 |
| 18.3 | 2.05 |
| 18.4 | 2.20 |
| 18.6 | 2.20 |
| 18.8 | 1.95 |
| 19.0 | 1.95 |
| 19.2 | 2.10 |
| 19.4 | 2.08 |
| 19.9 | 2.20 |
| Average leak rate | 2.09 SCFM |

As will be seen from the above lists, the seals which contained oxidized wire exhibited leak rates which were approximately 16.7% lower than the leak rates which were exhibited by the seals which contained unoxidized wire. Further, it can be noted that while some seals contained greater quantities of wire material than others as evidenced by the weight of the seals, this had little bearing on the leak rates which were achieved, whereas the presence of oxides had a significant bearing on the leak rates.

It is seen, therefore, that the instant invention provides an effective method of forming a compacted-wire seal and an effective compacted wire seal. Seals, such as the seal 10, are economical to manufacture, and they can be effectively utilized in high-temperature applications wherein asbestos seals were previously utilized. Further, because the wires in the seals of the instant invention are oxidized during the manufacture of the seals, the finished seals have substantially reduced leak rate properties. Even further, since the seals formed by this method exhibit high degrees of flexibility and resiliency, they can be effectively utilized for sealing between adjacent elements. Hence, for these reasons, as well as they other reasons hereinabove set forth, it is seen that the method and seal of the instant invention represent significant advancements in the art which have substantial commercial merit.

While there is shown and described herein certain specific structure and method steps embodying the invention, it will be manifest to those skilled in the art that various modifications and rearrangements of the parts and details may be made without departing from the spirit and scope of the underlying inventive concept and that the same is not limited to the particular forms herein shown and described except insofar as indicated by the scope of the appended claims.

What is claimed is:

1. A method of forming a compacted wire ring seal comprising:

a. knitting a metal wire to form a tubular sock of a predetermined dimension;

b. rolling said sock on itself to form a knitted-wire ring;

c. heating said knitted-wire ring in an atmosphere containing oxygen to anneal the wire therein and to form metal oxides on the surfaces of said wire, said oxides comprising at least approximately 0.025 $m^3$ of oxide per $cm^2$ of wire surface; and d. compressing said knitted-wire ring to form a compacted wire-ring seal comprising at least approximately 45% by volumne of wire and oxide.

2. In the method of claim 1, said rolling step further characterized as rolling said sock on itself from both ends thereof to form a knitted-wire ring comprising two adjacent rolls.

3. In the method of claim 1, said knitting step further characterized as knitting a stainless-steel wire to form said sock.

4. The method of claim 1 further comprising the step of flattening said metal wire before knitting it into said tubular sock.

5. In the method of claim 1, said compressing step further characterized as compressing said knitted-wire ring in a die cavity.

6. In the method of claim 5, said compressing step further characterized as compressing said knitted-wire ring in a die cavity to form a compacted wire-ring seal having a V-shaped cross-sectional configuration.

7. A method of forming a compacted wire seal comprising:

a. flattening an elongated wire;

b. knitting said metal wire to form a knitted-wire sheet of a predetermined dimension;

c. rolling said sheet on itself to form a knitted-wire roll;

d. heating said wire roll in an atmosphere containing oxygen to anneal the wire in said roll and to form oxides on the surfaces of said wire, said oxides comprising at least approximately 0.025 $mm^3$ of oxide per $cm^2$ of wire surface; and e. compressing said wire roll in a die cavity to form a compacted wire seal comprising at least approximately 45% by volume of said wire and said oxide.

8. A method of forming a compacted wire-ring seal comprising:

a. flattening an elongated wire;

b. knitting said flattened wire into a tubular sock of a predetermined dimension;

c. rolling said tubular sock on itself from both ends thereof to form a knitted-wire ring comprising two adjacent rolls;

d. heating said knitted-wire rings in an atmosphere containing oxygen to form oxides on the surfaces of the flattened wire therein and to anneal said flattened wire, said oxides comprising at least approximately 0.025 $mm^3$ of oxide per $cm^2$ of wire surface; and e. compressing said knitted-wire ring in a die cavity to form a compacted wire ring seal comprising at least approximately 45% by volume of said wire and said oxide.

* * * * *

UNITED STATES PATENT AND TRADEMARK OFFICE

CERTIFICATE OF CORRECTION

PATENT NO. : 4,683,010

DATED : July 28, 1987

INVENTOR(S) : Hartmann, Hans J.

It is certified that error appears in the above-identified patent and that said Letters Patent is hereby corrected as shown below:

Claim 1, line 11 (column 9, line 25), change "$m^3$" to --$mm^3$--.

Signed and Sealed this

Nineteenth Day of May, 1992

*Attest:*

DOUGLAS B. COMER

*Attesting Officer*

*Acting Commissioner of Patents and Trademarks*